US008590353B2

(12) United States Patent
Lengauer et al.

(10) Patent No.: US 8,590,353 B2
(45) Date of Patent: Nov. 26, 2013

(54) PROCESS FOR PRODUCING SHAPED COMPONENTS FROM HIGH-STRENGTH AND ULTRA HIGH-STRENGTH STEELS

(75) Inventors: Gerhard Lengauer, Bad Zell (AT); Robert Wurzer, Hof bei Salzburg (AT); Christoph Bauernberger, Krems (AT); Franz Weitz, Krems-Stein (AT); Christoph Dockner, Theyern (AT); Kenichi Watanabe, Akashi (JP); Yasuhiro Hayashida, Kobe (JP); Masayoshi Okumura, Ashiya (JP); Hiroki Nakayama, Kobe (JP)

(73) Assignee: voestalpine Krems GmbH, Krems (AT)

( * ) Notice: Subject to any disclaimer, the term of this patent is extended or adjusted under 35 U.S.C. 154(b) by 435 days.

(21) Appl. No.: 12/809,961

(22) PCT Filed: Dec. 4, 2008

(86) PCT No.: PCT/EP2008/010307

§ 371 (c)(1),
(2), (4) Date: Sep. 10, 2010

(87) PCT Pub. No.: WO2009/080185

PCT Pub. Date: Jul. 2, 2009

(65) Prior Publication Data

US 2011/0003113 A1 Jan. 6, 2011

(30) Foreign Application Priority Data

Dec. 20, 2007 (DE) ..... 10 2007 061 475

(51) Int. Cl.
*B21B 15/00* (2006.01)

(52) U.S. Cl.
USPC ..... 72/177; 72/340

(58) Field of Classification Search
USPC ..... 72/176, 177, 179, 181, 199, 203, 224, 72/340; 29/897, 897.2, 897.35
See application file for complete search history.

(56) References Cited

U.S. PATENT DOCUMENTS 1,733,199 A * 10/1929 Myers ..... 72/124
3,475,937 A * 11/1969 Lawler ..... 72/181

(Continued)

FOREIGN PATENT DOCUMENTS

DE 2907677 9/1979
DE 60100436 T2 7/2004

(Continued)

OTHER PUBLICATIONS

Notice of Preliminary Rejection issued by the Korean Intellectual Property Office on Apr. 23, 2012, Korean Patent Application No. 2010-7016118, 6 pages.
DIN 50 969, Preisgr. 6, Vertr.-Nr. 0006, Dec. 1990.
First Office Action issued by the State Intellectual Property Office of People's Republic of China on Jul. 17, 2012, Chinese application No. 200880127110.7, 3 pages.

*Primary Examiner* — Edward Tolan
(74) *Attorney, Agent, or Firm* — Setter Roche LLP

(57) ABSTRACT

This invention pertains to a process for producing shaped components from high-strength and ultra high-strength steels with tensile strengths >780 MPa, wherein a steel sheet-metal strip is fed to a roll-forming installation and in the roll-forming installation is passed through roll stands and deformed by means of deformation rollers acting on the steel sheet, and wherein to avoid hydrogen embrittlement in plastically deformed regions of the deformed steel sheet-metal strip compressive stresses are introduced by stamping and/or upset-forging and/or overbending and bending-back or by machining the strip edges.

10 Claims, 6 Drawing Sheets

(56) References Cited

U.S. PATENT DOCUMENTS

| | | | | |
|---|---|---|---|---|
| 3,689,970 | A | 9/1972 | Falkner | |
| 4,080,815 | A * | 3/1978 | Foster | 72/168 |
| 4,593,550 | A * | 6/1986 | Byrd | 72/199 |
| 4,658,615 | A * | 4/1987 | Mitchell | 72/12.7 |
| 5,163,225 | A * | 11/1992 | Goleby | 29/897.35 |
| 5,551,272 | A * | 9/1996 | Knudson | 72/181 |
| 5,761,947 | A * | 6/1998 | Barnes | 72/203 |
| 5,829,666 | A | 11/1998 | Takeda et al. | |
| 6,148,654 | A * | 11/2000 | Jensen et al. | 72/181 |
| 6,604,397 | B2 * | 8/2003 | Patty et al. | 72/178 |
| 7,197,824 | B1 | 4/2007 | Graber | |
| 7,842,142 | B1 | 11/2010 | Kusumi et al. | |
| 2007/0074556 | A1 * | 4/2007 | Heatherington | 72/177 |

FOREIGN PATENT DOCUMENTS

| | | | |
|---|---|---|---|
| DE | 102004040259 | A1 | 12/2005 |
| DE | 60127879 | T2 | 9/2007 |
| EP | 0449599 | A1 | 10/1991 |
| EP | 1088606 | A2 | 4/2001 |
| JP | 475615 | | 7/1992 |
| JP | 09323130 | | 12/1997 |
| JP | 9323130 | | 12/1997 |
| JP | 2004167572 | A | 6/2004 |
| JP | 200566635 | | 3/2005 |

* cited by examiner

PROCESS FOR PRODUCING SHAPED COMPONENTS FROM HIGH-STRENGTH AND ULTRA HIGH-STRENGTH STEELS

FIELD OF THE INVENTION

The invention relates to a process for producing components (e.g. for cars: sillboard, bumpers, side impact protection bars, security parts, pillars, roof rails, cross members, side members, stiffeners, suspension members and suchlike) from high-strength and ultra high-strength steels with tensile strengths >780 MPa and to components produced by the process.

BACKGROUND OF THE INVENTION

It is known to shape or deform high-strength and ultra high-strength steels in order to produce components from these steels. These shaping processes may, for example, include deep-drawing, stamping or roll-forming processes.

U.S. Pat. No. 7,197,824 B1 discloses a two-step system or stage to manufacture a bumper of "B" shape cross-section including a roll forming-welding stage where a straight cross member of a length to mount on the front or rear of various models of automobiles and the bending stage where any curvature or sweep is introduced into the cross member as required by the design of the automobile. The roll forming welding stage includes the spot or tack welding of the front wall to the web followed immediately by welding together without any gaps therebetween the abutting longitudinal edges utilizing a high frequency welder. Thus, the "B" shaped cross-section of the bumper may be used to make different bumpers of various lengths and curvatures.

The mechanical shaping of steel materials of this type leads to an increased occurrence of embrittlement phenomena, leading to crack formations in the material either immediately upon shaping or after a certain time.

These crack formations are explained by metallurgical inclusions of hydrogen from the environment in the material.

These inclusions are influenced to a very considerable extent by the local stress state in the material. The inclusion of hydrogen occurs to a very considerable extent in regions that are subject to tensile stresses. No or fewer inclusions are found in the region or regions that are subject to compressive stresses. This effect is very greatly magnified as the tensile strength of the material rises.

The effect is exacerbated still further by various sources of hydrogen which can preclude the use of a surface coating or can also lead to components of poor quality.

In standard processes used to produce components of this type, in particular in the automotive industry, for example during pressing, stamping and deep-drawing, very high tensile loads are involved in the production of the materials.

However, embrittlement and cracking of this type occurs not only in the regions that have been very strongly deformed, but also in the edge region, i.e. in the regions in which cutting or parting has taken place. This effect too is attributable to stress states and micro-cracking in the cut region.

However, this disadvantageous hydrogen embrittlement also occurs when high-strength and ultra high-strength steels of this type are welded. The effect of heat and correspondingly also of environmental elements or the atmosphere leads, in the region of the weld seam, to cracks attributable to hydrogen embrittlement. Despite these drawbacks, there is no substitute for these high-strength and ultra high-strength steels in the automotive industry, since reduced weight is nowadays a fundamental requirement of the automotive industry. Weight reduction of this type, however, can only be realized by using steels of considerably higher strength. However, one drawback is that the above-described hydrogen embrittlement and the properties of these steels mean that it is only possible to achieve certain degrees of deformation, which are lower than what would truly be desired. As a result, the shaping is subject to considerable restrictions and can only be achieved by large radii and short deep-drawing distances.

It is an object of the invention to provide a process for producing components from high-strength and ultra high-strength steels which can be used to achieve high degrees of deformation and to avoid embrittlement and cracking.

A further object of the invention is to provide a component made from a high-strength and ultra high-strength steel which has high degrees of deformation but in which no hydrogen embrittlement occurs.

SUMMARY OF THE INVENTION

According to the invention, the forming operation can be used to influence the stress state of the components by deforming the components made from high-strength and ultra high-strength steels in what are known as roll-forming installations with a suitable tooling design, without it being necessary to accept major restrictions in terms of shape and component geometries.

In this case, the drawbacks which have been described can advantageously be avoided in all regions of the work piece, i.e. both in the region of bending radii and in the region of edges as well as at weld seams.

To influence the stress states in the strip edge and to avoid hydrogen embrittlement here, according to the invention, the strip edges are upset-forged or stamped. According to the invention, this strip edge stamping or upset-forging or deformation is carried out at an angle of, for example, 15° to 60° with respect to the perpendicular.

Deformation, stamping or upset-forging of this type can be effected by profiled rollers or obliquely disposed rollers prior to the roll-profiling during longitudinal cutting to size, in the roll-forming installation at the strip entry upstream of the actual deformation region, in the deformation region or downstream of the deformation region in the strip exit.

Another possibility according to the invention for processing the strip edges (45° to 90° in relation to the strip surface) provides for the correspondingly plastically deformed regions not to be neutralized by means of compressive stresses, but rather for the corresponding components to be provided with an oversize in the region of the edges, which is then removed by milling, grinding, planing, shaving or other machining processes. The machining stations correspond to the ones used for the stamping operation, wherein straight or obliquely disposed machining rollers or tools can be used. The amount of material removed is typically between 0.1 and 0.5 mm. Another advantage achieved herewith is that surfaces are smoothed, so that notches are avoided.

To avoid cracks and hydrogen embrittlement in the deformed regions of the component, deformation in the roll-forming installation can be carried out in ascending or descending mode. The term ascending or descending means that during the roll-forming the component base is lowered is raised with respect to the entry plane of the flat sheet. By suitably selecting the shaping mode (ascending or descending) in the roll-forming process, it is possible according to the invention to have a significant influence on the stress state in the component. The shaping mode may in this case be rising or descending at between 0.1 and 0.6 times the component height.

Another way of avoiding cracks in the deformed regions of the component is additional deformation by means of intermediate rollers in the roll-forming installation, in which case these intermediate rollers stretch the component to a greater extent in the regions that are to be deformed than would fundamentally be necessary to achieve the final shape. The subsequent profiling partly reduces this stretching again, so that the tensile stresses which were originally present can be compensated for by compressive stresses which are then reintroduced. Specifically, intermediate rollers can be used to reduce the spring-back between the roll stands, in which case over-bending in the opposite direction, i.e. an excessive introduction of tensile stresses, is possible. Intermediate rollers of this type may be arranged throughout the entire deformation region of the roll-forming installation, i.e. between all the roll stands. Specifically, however, intermediate rollers of this type should be present in the end region of the respective forming stage or in the end region of the roll-forming installation. The distance from the roll stand is in this case between 100 and 300 mm, and it is preferable to use cylindrical rollers. It is also possible to use conical rollers with a cone angle of from 45° to 90°.

It is also possible to use a plurality of rollers, in which case it should be possible to optimize the over-bending by adjustment in the horizontal and vertical directions.

According to the invention, to avoid cracks and hydrogen embrittlement in the weld seam region, the strip edges are pre-machined so as to deliberately influence stress states.

Tensile stresses are converted towards compressive stress or are eliminated.

Moreover, during and after the welding operation, it is possible to deny access to potential hydrogen sources.

The machining may comprise chip-forming machining, such as milling, grinding, planing or shaving, in which case, as in the other processes, compressive stresses can also be applied by corresponding rollers.

Both the chip-forming machining (45° to 90° relative to the strip edge) and the application of compressive stresses can be effected by means of straight or obliquely (15° to 60°) disposed rollers or tools, in which case the corresponding influencing measures can take place upstream of the roll-profiling in the cutting-to-length installation in the roll-forming installation in the strip entry upstream of the forming region in the forming region itself or downstream of the forming region in the strip exit of the installation prior to welding.

If a chip-removing or other material-removing machining operation is carried out, this likewise takes place at a distance of from 0.1 to 0.5 mm from the free longitudinal edge.

Moreover, during thermal processing a heat-induced reduction of stresses in the edge region can be carried out as well as the abovementioned elimination of potential hydrogen sources and/or impurities.

BRIEF DESCRIPTION OF THE DRAWINGS

The invention is explained by way of example with reference to a drawing, in which.

DETAILED DESCRIPTION OF THE PREFERRED EMBODIMENTS

Figure 1:
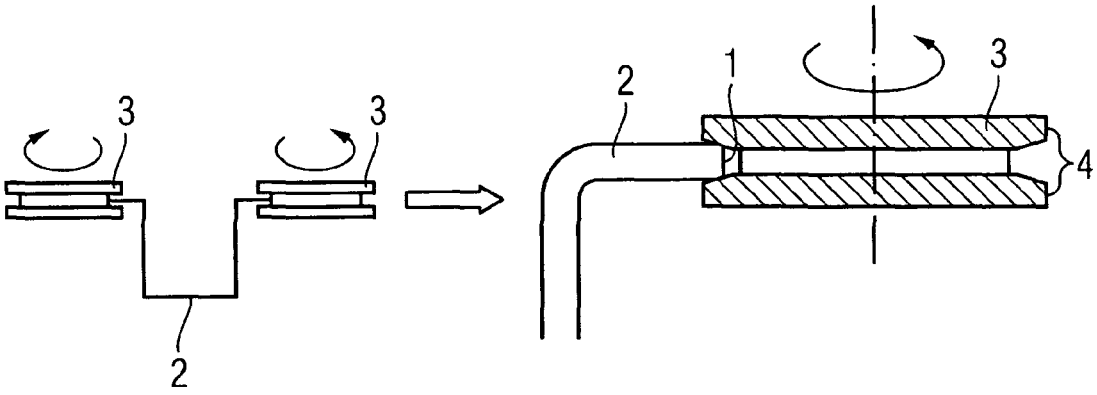
FIG. 1 shows the influencing of the stress state in the strip edge by deformation or stamping.

The stamping according to the invention of the strip edges 1 of a strip 2 in order to reduce tensile stresses in the region of the strip edge 1 can be carried out, for example, using a roller 3 with a wedge-shaped or V-shaped contact surface 4 (FIG. 1), in which case a roller 3 of this type provides the edge 1 with two upset-forged chamfers. In this way, the tensile stresses that have occurred in the sensitive regions are compensated for by compressive stresses. The result of stamping of this type can be seen in FIG. 2, wherein the stamping can be carried out to such an extent that material is even compressed together in the region of a free end face 5 of the longitudinal edge, so that a pressure is formed even throughout the entire region of the free end face 5 all the way to the neutral chamfer of the metal sheet.

Figure 3:
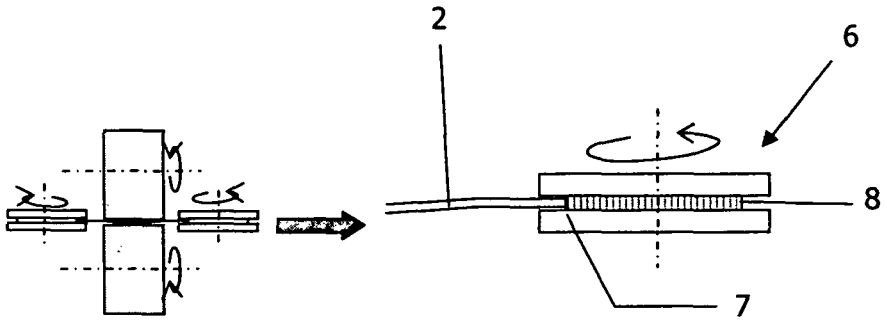
FIG. 3 shows the removal according to the invention of regions with tensile stresses in the strip edge.

It is also possible for corresponding tensile stresses to be eliminated in the region of the free longitudinal edge by using a roller 6 (FIG. 3) to remove the tensile stress region of the free longitudinal edge 7 of the sheet 2 or strip 2. In this case, the removal is carried out to a depth of from 0.1 to 0.5 mm, by means of chip-forming or grinding machining using a suitably designed tooling roller 6 with a grinding surface 8 or a suitable tool. Unlike in the abovementioned process, this does not result in any deformation of the longitudinal edge, but the area that is to be removed must be taken into account when dimensioning the sheet 2 or strip 2 and component, i.e. a corresponding oversize needs to be produced.

Figure 4:
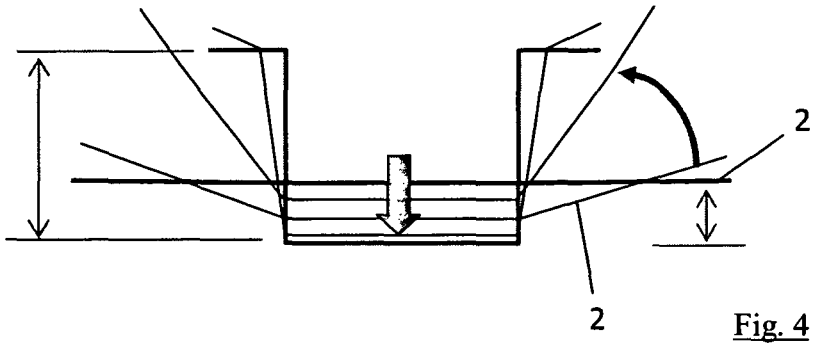
FIG. 4 shows an ascending or descending deformation in a roll-forming installation.

To ensure corresponding compressive stresses in the bending regions of the sheet-metal component as well, according to the invention a shaping mode in the roll-forming installation that deviates from the horizontal, i.e. from the entry plane of the sheet 2, into the roll-forming installation is provided. In this case, the deviation from the horizontal may be descending or ascending; FIG. 4 shows a descending shaping mode. According to the invention, it has been found that the stress state in the component can be significantly influenced by suitable selection of the shaping mode in the roll-forming process (ascending or descending), in particular since the shaping mode correspondingly applies a pressure to the metal sheet that is being slowly deformed in the region of the main deformation regions, and this pressure compensates for the corresponding occurrence of tensile stresses.

Figure 5:
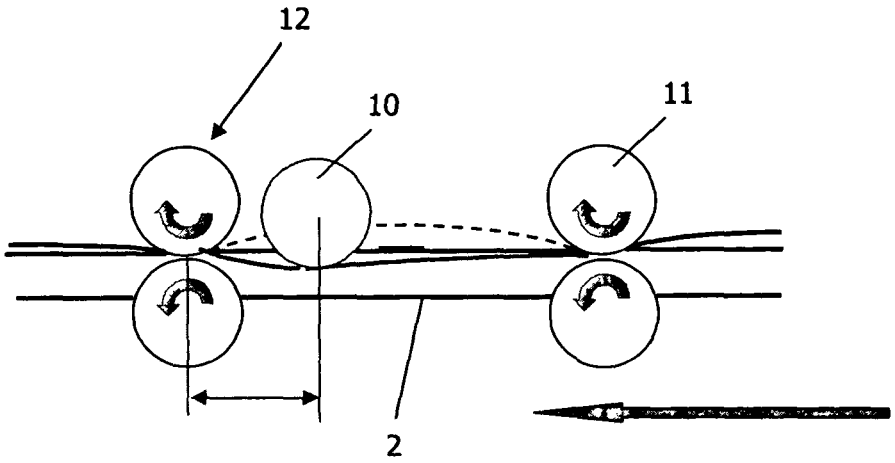
FIG. 5 shows the deformation according to the invention by means of intermediate rollers in the roll-forming installation.
Figure 6:
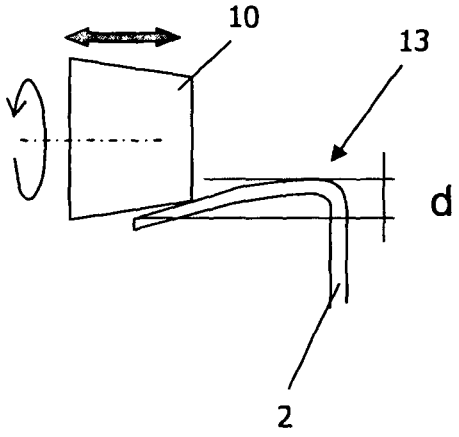
FIG. 6 shows the operating of the intermediate roller on the strip.

As an alternative or in addition, the stress states in the finished component can be influenced by means of intermediate rollers in the roll-forming process, as shown in FIG. 5. In this case, an intermediate roller 10 is arranged between a roll stand 11 and a final roll stand 12, for example 100 to 300 mm from the final roll stand 12, towards the end of the roll-forming process brings about over-bending or over-stretching of a bending region 13, which is then cancelled out again by bending-back in the final roll stand 12. This bending-back compensates for the tensile stresses that are present in the material, so that in this case too much embrittlement is prevented.

Figure 8:
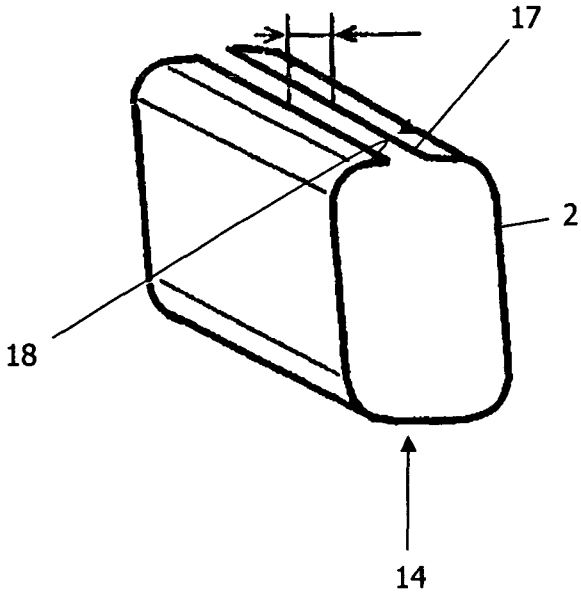
FIG. 8 shows a tubelike part with a longitudinal opening in the wall and welding edges of the opening.

In the case of tubes 14 that are to be welded with a longitudinal weld seam (FIG. 8), it is possible to employ the same mechanisms in order for the weld seam regions to be formed with low stresses or without any stresses. Accordingly, it is possible both to mechanically eliminate the stress regions of the longitudinal edges 17, 18 or to suitably upset-forge the longitudinal edges 17, 18.

Figure 7:
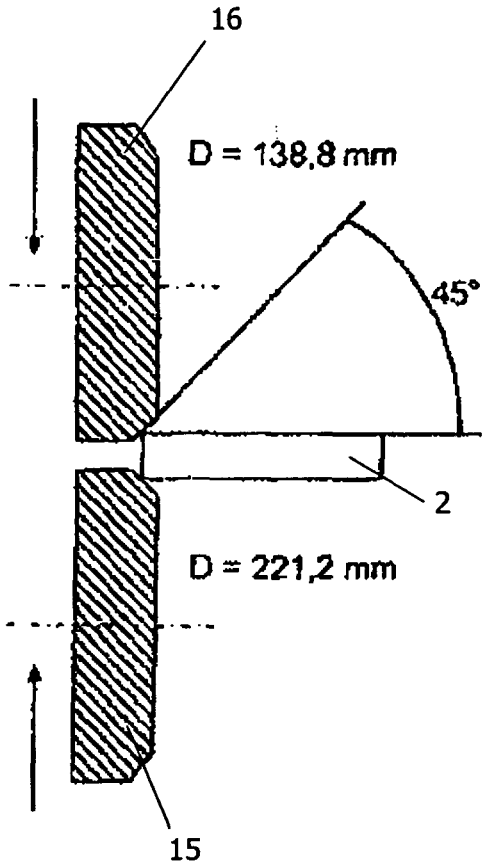
FIG. 7 shows, in highly schematic form, another arrangement for the machining of the strip edges by stamping or removing rollers.

Such an upset-forging or a mechanical elimination of the stress regions of the sheet 2 or tube 14 of this type is possible using rollers 15, 16 which lie opposite one another with respect to the edge upper and lower sides (FIG. 7) and which correspondingly act on both sides of the edge. In this context, the configuration shown in FIG. 7 is not restricted to the stamping of weld seam edges, but rather can of course also be used to machine other profile edges.

Figure 9:
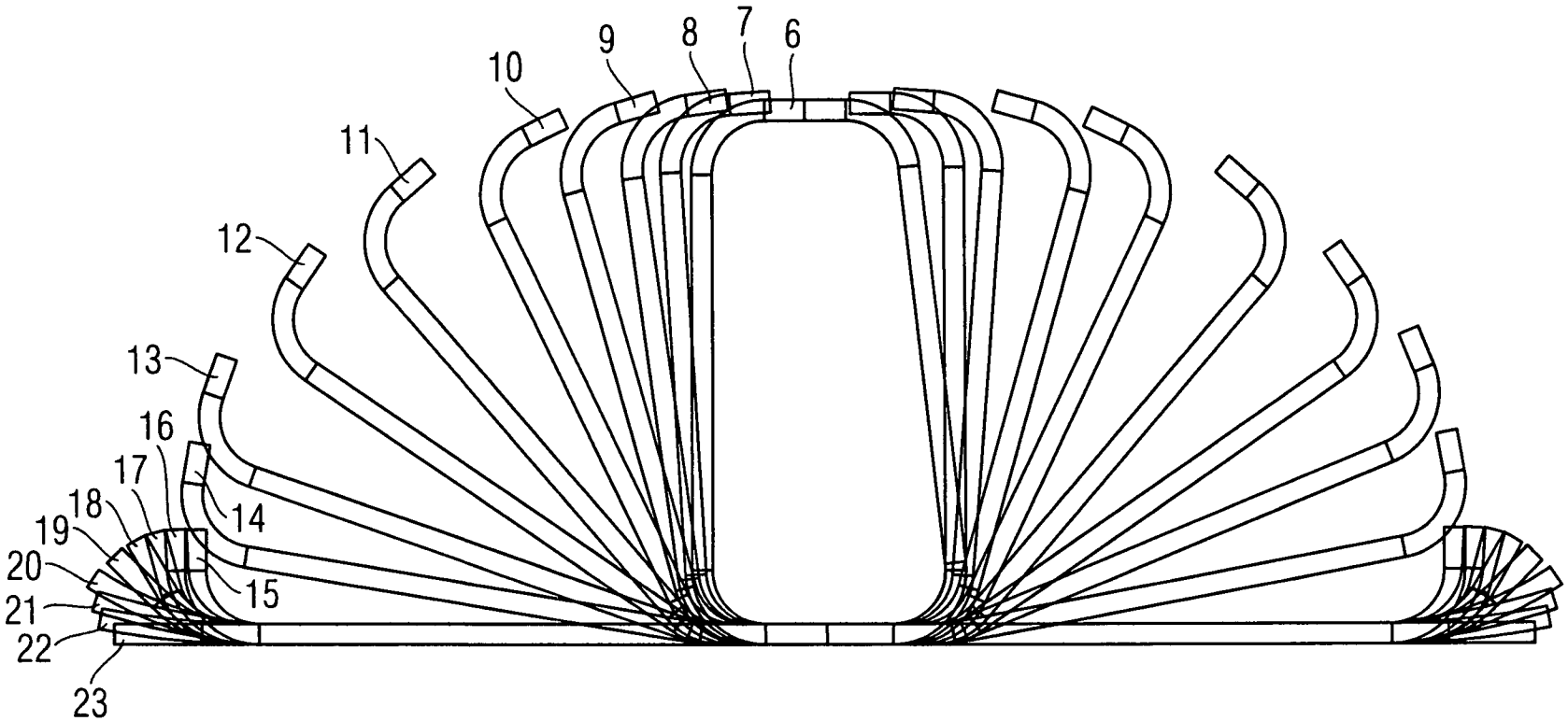
FIG. 9 shows an ascending or descending deformation in the roll-forming installation with over-stamping.

FIG. 9 again shows ascending and descending deformation mechanisms of a tube 14, with the individual deformation steps v6 to v23 illustrated here.

Figure 10:
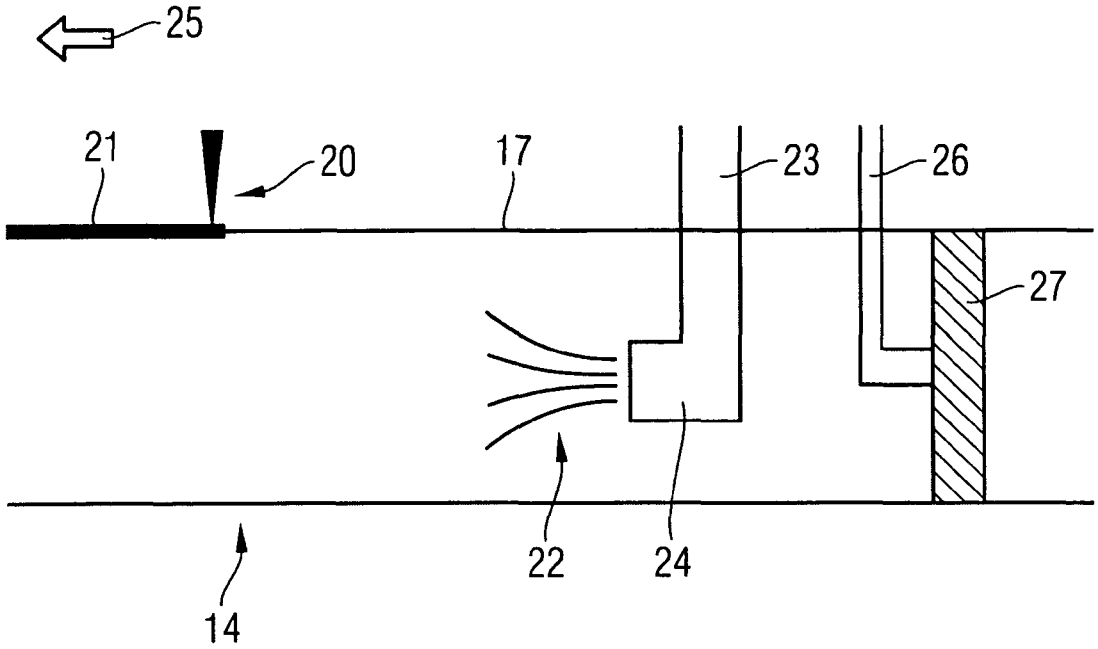
FIG. 10 shows, in highly schematic form, the use of separating media in the inner region of the tube and partitioning-off of the lubricating media between roll-forming part and welding part to prevent hydrogen from gaining access.

Moreover, during longitudinal welding of tubes 14 it is advantageously possible to influence the possible introduction of hydrogen. For example, according to FIG. 10, the tube 14 that is to be welded with a weld seam 21 can be flushed with inert gas on the inside upstream of the actual welding device 20, for example a laser 20, relating to the transportation direction 25, in order to ensure a shielding gas atmosphere that is free of hydrogen. For this purpose a gas flushing probe 23 can be extended into the tube 14 between the edges 17, 18 and discharge the flushing gas 22 through a nozzle 24.

To eliminate any residual water or lubricants from preceding process steps without leaving any residues, it is also possible for a scraper 26 to be arranged in the tube inner region, shielding the welding zone from an atmosphere that contains water vapour and wiping the inner tube 14 with a wiping device 27. Moreover, the inert gas can be heated.

Figure 11:
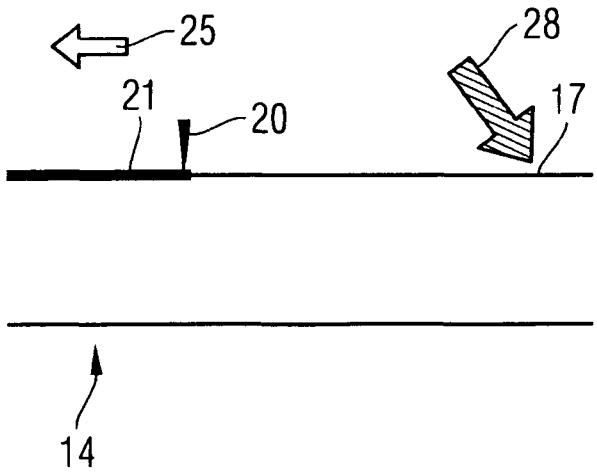
FIG. 11 shows, in highly diagrammatic form, cleaning and drying of the strip edges immediately prior to the welding process.

As shown in FIG. 11, it is also possible for the strip edges 17, 18 to be suitably cleaned and/or dried using an airstream 28 or similar gas streams, in particular hot gas streams, upstream of the actual welding device 20 relating to the transportation direction 25.

EXAMPLES

Example 1

Study on a Roll-Formed Hat Channel

Example 1-1

Experiment of Applying a Compressive Stress by Stamping an End Portion

A hat channel was fabricated by conveying a an ultra high-strength steel strip having a tensile strength of 1300 MPa to a roll-forming line to pass the steel strip through roll stands so that forming rollers act on the steel strip to thereby perform roll-forming into the hat channel.

It was examined whether stamping a flange end with a roller to apply a compressive residual stress to the flange end during the roll-forming can offset a tensile residual stress of a flange portion. An angle of stamping was set to be 45 degrees with respect to a surface of the end.

Figure 2:
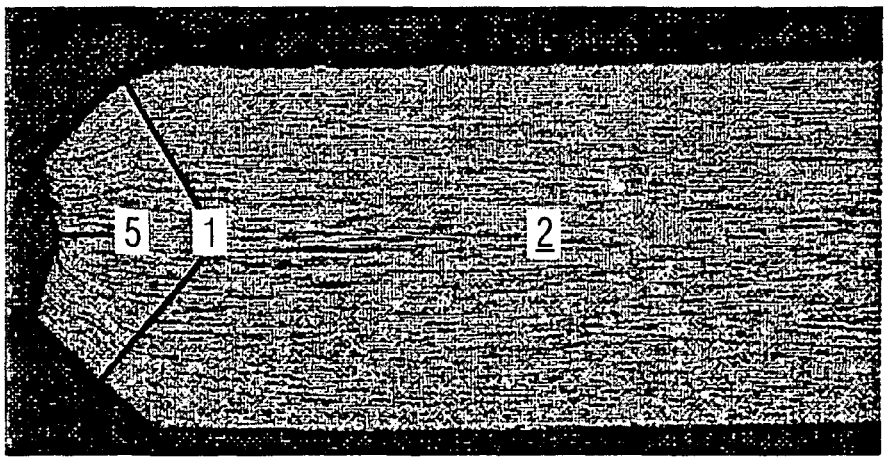
FIG. 2 illustrates a strip edge that has been stamped or deformed according to the invention.

As a result, as shown in FIG. 2, it was confirmed that stamping the flange end generates a compressive residual stress in a longitudinal direction.

The acquired hat channel was immersed in a 5% hydrochloric acid for a predetermined time period up to 24 hours to accelerate a delayed fracture (5% hydrochloric acid-immersion test). Existence or absence of occurrence of the delayed fracture in the hat channel was evaluated with eyes after the immersion. As a result, the delayed fracture was not found even after immersion for 24 hours.

Example 1-2

Experiment of Controlling Steel Deformation by an Intermediate Roller During Roll-Forming A hat channel was fabricated by roll-forming an ultra high-strength steel strip having a tensile strength of 1000 MPa in a manner similar to that of Example 1-1, except for the following process.

In other words, in place of stamping in Example 1-1, it was examined whether controlling overbending and bending-back of the flange portion with a guide roller provided between roll stands during the roll-forming can reduce a tensile residual stress of the flange portion. A bending angle of the overbending was 20 degrees greater than that of a bending angle of the component.

As a result, the delayed fracture was not found in the 5% hydrochloric acid-immersion test even after immersion for 24 hours.

Example 1-3

Experiment of Controlling Steel Deformation by Downhill-Forming

A hat channel was fabricated by roll-forming an ultra high-strength steel strip having a tensile strength of 1300 MPa in a manner similar to that of Example 1-1, except for the following process.

In other words, in place of stamping in Example 1-1, it was examined whether controlling extensional deformation of the flange portion by a forming mode of bending the steel strip downward from a flat plane during the roll-forming can apply a compressive residual stress to the hat flange. A size of a downward declination from the flat plane in the downhill mode was set to be 30 percent of a height of the hat.

As a result, the delayed fracture was not found in the 5% hydrochloric acid-immersion test even after immersion for 24 hours.

Example 1-4

Experiment of Removing a Plastically Deformed Region by Grinding an End Portion A hat channel was fabricated by roll-forming an ultra high-strength steel strip having a tensile strength of 1500 MPa in a manner similar to that of Example 1-1, except for the following process.

In other words, in place of stamping in Example 1-1, it was examined whether, during the roll-forming operation, a combination of removing and smoothing a work-hardening layer by grinding a flange end surface and downhill forming in which a size of a downward declination from a flat plane in the downhill mode was set to be 10 percent of a height of the hat can reduce the amount of hydrogen inclusion to the flange end portion. A grinded width was set to be 0.1 mm and 0.3 mm.

As a result of the 5% hydrochloric acid-immersion test, the delayed fracture was not found in both cases even after immersion for 24 hours.

Comparative Example 1

A hat channel, which was fabricated by conventionally roll-forming an ultra high-strength steel strip having a tensile strength of 1300 MPa without especially applying a compressive stress to a plastically deformed region and without removing a plastically deformed region by grinding an end portion, was used in a comparative experiment.

As a result, occurrence of the delayed fracture in the flange portion of the hat channel was found in the 5% hydrochloric acid-immersion test already after immersion for 24 hours.

Example 2

Study on Welding in a Roll-Formed Square Pipe

Example 2-1

Experiment of Shielding Inside of the Pipe by an Inactive Gas

An ultra high-strength steel strip having a tensile strength of 1300 MPa was conveyed to a roll-forming line to pass the steel strip through roll stands so that forming rollers act on the steel strip to thereby perform roll-forming into a tube having longitudinal ends facing each other and defining an opening extending in a longitudinal direction is formed. During the roll-forming, overbending of the flange portion with an intermediate roller provided between roll stands was performed, the bending angle of which was 15 degrees greater than that of the component. Successively, the opening was welded by laser welding, so that a square pipe was fabricated.

It was examined whether welding the pipe while shielding inside of the pipe with a He gas can prevent embrittlement after the laser welding.

After the laser welding in a predetermined welding speed, existence or absence of embrittlement in a weld seam of the square pipe was evaluated. As a result, embrittlement did not occur in the weld seam.

Example 2-2

Experiment of Removing Moisture and Lubricant from a Welded Portion

A square pipe was fabricated by roll-forming an ultra high-strength steel strip having a tensile strength of 1500 MPa and by applying laser welding, in a manner similar to Example 2-1.

However, it was examined whether embrittlement after the laser welding can be prevented by injecting a high-pressure air before welding to remove moisture and lubricants residing in the welded portion, and thereafter by welding the pipe while shielding inside of the pipe with a He gas in a manner similar to Example 2-1.

As a result, embrittlement did not occur in the weld seam.

Comparative Example 2

A tube having open ends which was roll-formed by using an ultra high-strength steel strip having a tensile strength of 1300 MPa was formed into a square pipe by welding the opening by applying normal laser welding. This pipe was used in a comparative experiment.

As a result, occurrence of embrittlement in the weld seam was confirmed.

As a result, the process according to the invention achieves very good welding results without cracks, both immediately after the welding as well as on compression specimens.

An advantage of the invention is that hydrogen embrittlement and associated crack formation are avoided in the region of welded edges and in the region of bent edges of components; the roll-forming process is particularly effectively able to incorporate process steps of this type in-line.

The invention claimed is:

1. A process for producing shaped components from high-strength and ultra high-strength steels with tensile strengths >780 MPa, comprising:

feeding a steel sheet-metal strip having longitudinal edges to a roll-forming installation and in the roll-forming installation passing the steel sheet-metal strip through roll stands and deforming the steel sheet-metal strip using deformation rollers acting on the steel sheet;

in order to avoid hydrogen embrittlement in plastically deformed regions of the deformed steel sheet-metal strip, introducing compressive stresses to the steel sheet-metal strip by overbending and bending-back to a desired component geometry;

for the over-bending, in particular of flange regions, of profiled sections, using straight or conical rollers, which are arranged between the deformation roll stands; wherein the over-bending rollers are used to carry out bending which is greater than would be required for the shaping, and a subsequent roll stand then bends the over-bending back to the desired component geometry; and removing an oversize in the plastically deformed regions of the longitudinal edges by chip-forming or grinding machine.

2. The process according to claim 1, wherein the regions into which compressive stresses are introduced are at least one of the group consisting of: bent edges, bent regions, and free longitudinal edges.

3. The process according to claim 1, wherein additional rollers are present between the roll stands for the purposes of the over-bending and bending-back.

4. The process according to claim 1, wherein the plastically deformed regions of the longitudinal edges are removed by milling, grinding, shaving or planning.

5. The process according to claim 4, wherein 0.1 to 0.5 mm of material is removed from the longitudinal edge.

6. The process according to claim 1, comprising using rollers with a V-shaped wedge or two rollers which act in a corresponding way on the edge for the stamping or upset-forging of the longitudinal edges, so that chamfers are stamped into the top and bottom sides of a free longitudinal edge.

7. The process according to claim 5, wherein the material of the longitudinal edges is removed in an angle of 45° to 90°.

8. The process according to claim 6, wherein the chamfers are stamped into the edges in an angle of 15° to 60° relating to a vertical axis.

9. The process according to claim 1, wherein the overbending rollers are arranged to the subsequent roll stand in a distance of 100 to 300 mm.

10. The process according to claim 1, wherein the overbending is made with 5° to 30° more than the desired component geometry.

* * * * *